US009261826B2

(12) United States Patent
Kataoka et al.

(10) Patent No.: US 9,261,826 B2
(45) Date of Patent: Feb. 16, 2016

(54) IMAGE FORMING APPARATUS

(71) Applicant: CANON KABUSHIKI KAISHA, Tokyo (JP)

(72) Inventors: Hiroshi Kataoka, Suntou-gun (JP); Shuji Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/737,901

(22) Filed: Jun. 12, 2015

(65) Prior Publication Data

US 2015/0362876 A1 Dec. 17, 2015

(30) Foreign Application Priority Data

Jun. 17, 2014 (JP) ..... 2014-124560
May 25, 2015 (JP) ..... 2015-105776

(51) Int. Cl.
*G03G 15/20* (2006.01)

(52) U.S. Cl.
CPC ..... *G03G 15/2028* (2013.01); *G03G 15/2039* (2013.01)

(58) Field of Classification Search
CPC ..... G03G 15/2028; G03G 15/2039
USPC ..... 399/68, 44
See application file for complete search history.

(56) References Cited

U.S. PATENT DOCUMENTS 9,031,443 B2 5/2015 Kaida et al.
2015/0071666 A1* 3/2015 Konno ..... G03G 15/2039 399/67

FOREIGN PATENT DOCUMENTS

| | | | |
|---|---|---|---|
| JP | 07-248700 | A | 9/1995 |
| JP | 2010-128076 | A | 6/2010 |
| JP | 2013-037084 | A | 2/2013 |
| JP | 2013-137514 | A | 7/2013 |
| JP | 2013-182114 | A | 9/2013 |

* cited by examiner

*Primary Examiner* — Susan Lee
(74) *Attorney, Agent, or Firm* — Fitzpatrick, Cella, Harper & Scinto

(57) ABSTRACT

An acquisition portion acquires a rate of a size of a toner image being formed in a predetermined area on a recording material to a size of the predetermined area, in a consecutive print job, a control portion sets a longer conveyance interval between a preceding recording material and a subsequent recording material when the rate of the subsequent recording material exceeds a threshold than when the rate of the subsequent recording material does not exceed the threshold, and the predetermined area on a trailing end side of the recording material with respect to a center of the recording material in a recording material conveying direction is larger than the predetermined area on a leading end side of the recording material with respect to the center of the recording material, or the predetermined area is only on the trailing end side of the recording material.

11 Claims, 9 Drawing Sheets

LEADING END
TRAILING END
$S_2$
$S_1$
$A_3$
RECORDING MATERIAL CONVEYING DIRECTION
Lp
PERIPHERAL LENGTH OF PRESSING ROLLER

LEADING END
TRAILING END
$A_4$

IMAGE FORMING APPARATUS

BACKGROUND OF THE INVENTION

1. Field of the Invention

The present invention relates to an image forming apparatus using an electrophotographic system.

2. Description of the Related Art

In general, an image heating apparatus used for an image forming apparatus utilizing an electrophotographic system has a heating rotating member and a pressing rotating member that forms a nip along with the heating rotating member, and heats a toner image formed on a recording material while conveying the recording material through the nip.

The image heating apparatus often adopts a configuration in which one of the heating and pressing rotating members is rotationally driven, while the other one of the rotating member is driven as a result of drive of the one of the heating and pressing rotating members. In the image heating apparatus, when a recording material having absorbed moisture is heated while being conveyed through the nip, steam is generated. As is known, when the steam causes condensation on a surface of the heating rotating member or the pressing rotating member, the rotation speed of the driven rotating member decreases or the rotation is stopped, causing a phenomenon in which the recording material slips, that is, what is called a condensation slip.

Thus, Japanese Patent Application Laid-open No. 2013-137514 discloses an apparatus that extends a warm-up time in accordance with the temperature of a pressing roller to heat the surface of the pressing roller to hinder condensation.

However, disadvantageously, the extended warm-up time increases a first print out time (FPOT), degrading usability.

SUMMARY OF THE INVENTION

A first preferable embodiment according to the invention of the present application is an image forming apparatus that forms a toner image on a recording material comprising:

an image forming portion that forms an unfixed toner image on the recording material, based on image information;

a fixing portion that fixes the unfixed toner image on the recording material while heating and conveying the recording material, on which the unfixed toner image has been formed, at a nip portion, the fixing portion including a first rotating member that contacts the unfixed toner image and a second rotating member that forms the nip portion together with the first rotating member;

an acquisition portion that acquires, from the image information, a rate of a size of an area of the toner image in a predetermined area, which is a part of an image formable area on the recording material, to a size of an area of the predetermined area; and a control portion that controls conveyance of the recording material, wherein, in a consecutive print job, the control portion sets a longer conveyance interval between a preceding recording material and a subsequent recording material when the rate of the subsequent recording material exceeds a threshold than when the rate of the subsequent recording material does not exceed the threshold, and wherein a size of the predetermined area on a trailing end side of the recording material with respect to a center of the recording material in a recording material conveying direction is larger than a size of the predetermined area on a leading end side of the recording material with respect to the center of the recording material, or the predetermined area is only on the trailing end side of the recording material with respect to the center of the recording material.

A second preferable embodiment according to the invention of the present application is an image forming apparatus that forms a toner image on a recording material comprising:

an image forming portion that forms an unfixed toner image on the recording material, based on image information;

a fixing portion that fixes the unfixed toner image on the recording material while heating and conveying the recording material, on which the unfixed toner image has been formed, at the nip portion, the fixing portion including a first rotating member that contacts the unfixed toner image and a second rotating member that forms the nip portion together with the first rotating member;

an acquisition portion that acquires a rate of a size of an area of the toner image in a predetermined area, which is a part of an image formable area on the recording material, to a size of an area of the predetermined area; and a control portion that controls conveyance of the recording material, wherein, in a consecutive print job, the control portion sets a longer conveyance interval between a preceding recording material and a subsequent recording material when the rate of the subsequent recording material exceeds a threshold than when the rate of the subsequent recording material does not exceed the threshold, and wherein, when a length of the recording material is greater than a peripheral length of the second rotating member in the recording material conveying direction, a size of the predetermined area on a trailing end side of the recording material with respect to a predetermined position is larger than a size of the predetermined area on a leading end side of the recording material with respect to the predetermined position, or the predetermined area is only on the trailing end side of the recording material with respect to the predetermined position, and wherein the predetermined position is at a distance equal to the peripheral length of the second rotating member from a trailing end of the recording material in a recording material conveying direction.

Further features of the present invention will become apparent from the following description of exemplary embodiments (with reference to the attached drawings).

DETAILED DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments.

Embodiment 1

Image Forming Apparatus

Figure 2:
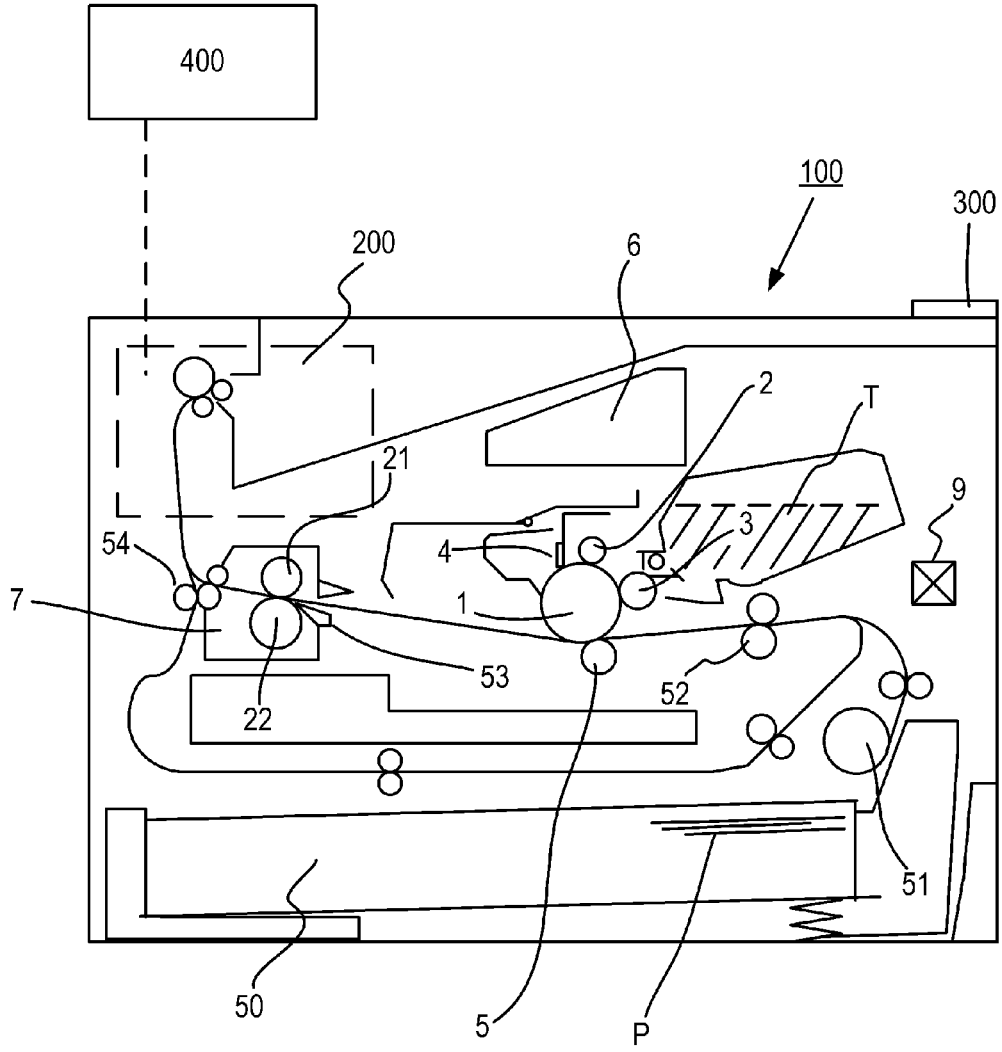
FIG. 2 is a cross-sectional view of an image forming apparatus according to Embodiment 1.

FIG. 2 is a schematic cross-sectional view depicting a general configuration of an example of an image forming apparatus according to an embodiment of the present invention. An image forming apparatus 100 according to the present embodiment is a monochromatic image forming apparatus that forms a black toner image on a recording material P using what is called an electrophotographic system.

The image forming apparatus 100 has a control circuit section 200 including a central processing unit (CPU) and to which electric image signals from an external host apparatus 400 such as a personal computer, an image reader, or a facsimile machine are input. Based on the electric image signal, the image forming apparatus 100 performs image formation on the sheet-like recording material P. The control circuit section 200 transmits and receives various pieces of electric information to and from the external host apparatus 400 and an operation section 300, while integrally controlling an image forming operation of the image forming apparatus 100 in accordance with a predetermined control program or reference table. Therefore, the image forming operation of the image forming apparatus 100 described below is controlled by the control circuit section 200.

An electrophotographic image forming section (hereinafter referred to as an image forming section) has a rotating drum-like electrophotographic photosensitive drum (hereinafter referred to as a photosensitive drum) 1 that is an image bearing member, and forms a toner image using electrophotographic process means explained later. The image forming section has charging means 2, image exposure means 6, developing means 3, cleaning means 4, and toner T as a developer. The image exposure means 6 uses a laser scanner unit. In the image forming section, the photosensitive drum 1, the charging means 2, the developing means 3, the cleaning means 4, and the toner T are collectively housed in one frame as an all-in-one cartridge (process cartridge) that can be integrally removed from the image forming apparatus main body.

The image forming apparatus 100 used for examinations in the present embodiment has an operating speed (hereinafter referred to as a process speed) of 231 mm/sec and enables image formation in which the sheet interval between the recording materials P is 27 mm and in which approximately 43 A4-sized sheets are processed per minute in a longitudinal direction.

The recording materials P are housed in a paper cassette 50, sequentially fed at predetermined control timings by a sheet feeding roller 51, and conveyed to a transfer nip portion at predetermined control timings by a registration roller 52. A toner image T developed on the photosensitive drum 1 by an electrophotographic process is transferred from the photosensitive drum 1 onto the recording material P through the transfer nip portion defined by the photosensitive drum 1 and a transfer roller 5. In the transfer nip portion, a potential difference is formed between the transfer roller 5 and the photosensitive drum 1 by a DC voltage applied to the transfer roller 5. After the toner image T is transferred onto the recording material P, toner remaining on the photosensitive drum 1 is removed by a cleaning blade 4 that is the cleaning means. The photosensitive drum 1 is then used for the next image forming process.

The recording material P is separated from the photosensitive drum 1 simultaneously with the transfer of the toner image T and introduced into an image heating apparatus (fixing section) 7 serving as fixing means. A melting and fixing process is executed on the recording material P, which is then discharged to the exterior of the image forming apparatus 100. A fixing inlet guide 53 provided in the image heating apparatus 7 serves to reliably guide and convey the recording material P separated from the photosensitive drum 1 and conveyed to the image heating apparatus 7, to a fixing nip portion N. A fixed sheet discharging roller 54 serves to discharge the recording material P subjected to fixing from a fixing unit.

The image forming apparatus 100 used in the present embodiment has a temperature and humidity sensor (environment detecting section) 9 that detects the temperature and humidity in the environment in which the image forming apparatus 100 is placed (the interior or peripheral vicinity of the apparatus). Process conditions for the image forming apparatus 100 are controlled in accordance with the detected temperature and humidity. Furthermore, the control circuit section 200 calculates a printing rate from image data transmitted from the external host apparatus 400 to the control circuit section 200.

The printing rate as used herein is defined as the percentage (rate) of the size of the area of an image printed in a predetermined area that is a part of a printable area (image formable area) of the recording material P, in the size of the predetermined area. In the present embodiment, condensation slip suppression control described below is performed in accordance with the calculated printing rate. The printing rate is, for example, 100% for an entire solid black image in which an image is formed all over the predetermined area of the recording material P and 0% for a solid white image in which no image is formed in the predetermined area.

(Image Heating Apparatus)

Figure 3:
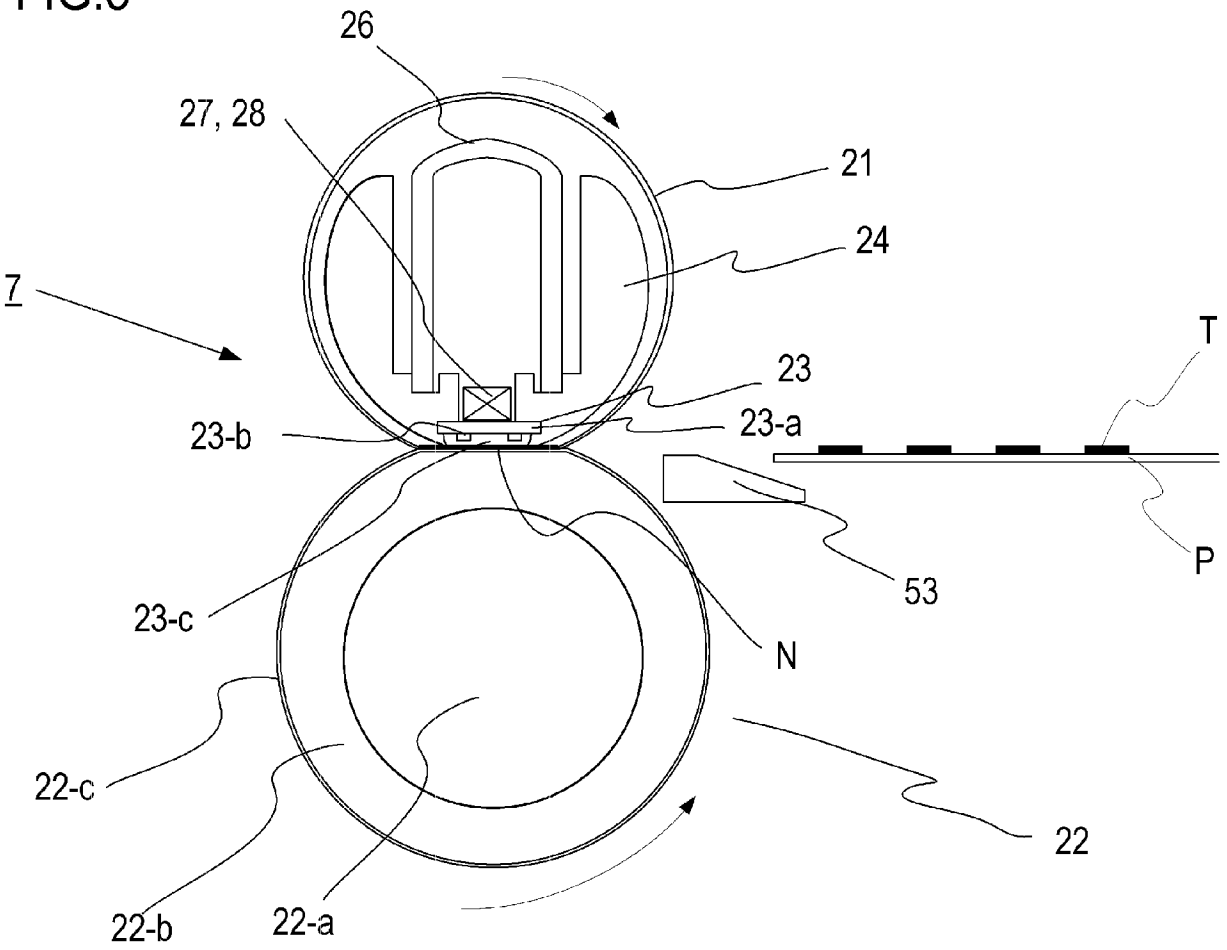
FIG. 3 is a cross-sectional view of a fixing section according to Embodiment 1.
Figure 4:
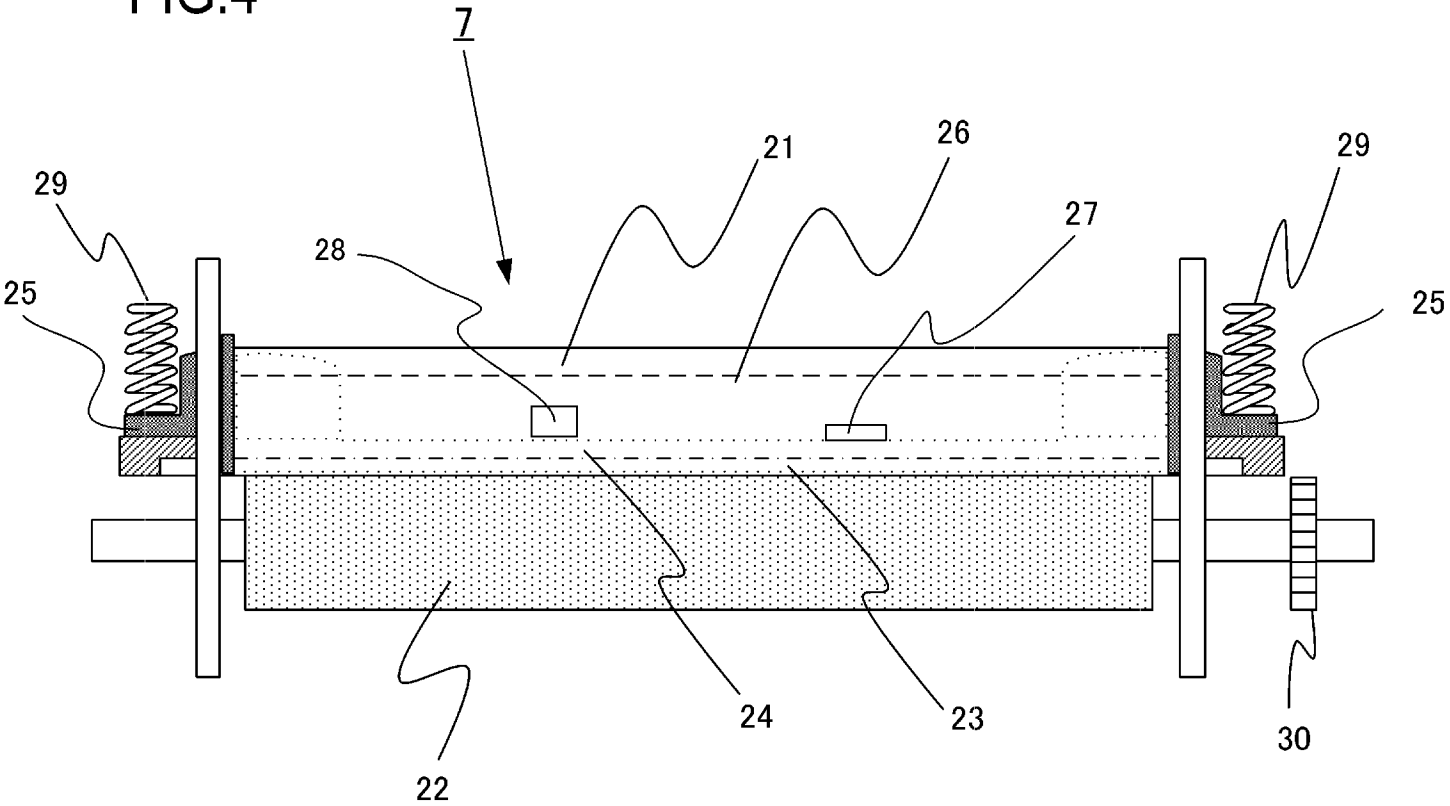
FIG. 4 is a diagram of the fixing section according to Embodiment 1 as viewed in a recording material conveying direction.

FIGS. 3 and 4 are diagrams illustrating a configuration of the image heating apparatus (fixing section) 7 in the present embodiment. FIG. 3 is a schematic cross-sectional view depicting a general configuration of a main part of the image heating apparatus 7. FIG. 4 is a schematic diagram of the general configuration (longitudinal configuration) of the main part of the image heating apparatus 7 as viewed in the recording material P conveying direction.

The image heating apparatus 7 used in the present example is based on a film heating system using a thin fixing film 21 having a low heat capacity to allow energy saving and a reduction in warm-up time. Compared to a heat roller system, the film-heating system allows a reduction in the heat capacity of the whole heating rotating member to enable quick start.

The image heating apparatus 7 has the fixing film 21 that is a flexible tubular film member and that serves as heating rotating member (first rotating member) and a pressing roller 22 (second rotating member) located opposite to the fixing film 21 to form the fixing nip portion N. The fixing film 21 is loosely fitted around an outer periphery of a heater holder 24 that is a support member arranged inside (inner peripheral side) the fixing film 21. A heater 23 is fixedly supported by the heater holder 24 so as to be in contact with an inner surface of the fixing film 21. The heater 23 has an energization heating resistance layer 23-*b* that generates heat when energized. The pressing roller 22 is arranged so as to be pressed against the heater 23 via the fixing film 21. Thus, the heater 23 comes into contact with the inner peripheral surface of the fixing film 21, and an outer peripheral surface of the fixing film 21 and an outer peripheral surface of the pressing roller 22 are brought into pressure contact with each other, thus forming the fixing nip portion N. When the pressing roller 22 rotates, a frictional force exerted between the outer peripheral surfaces causes the fixing film 21 to rotate around the heater holder 24 in conjunction with the rotation of the pressing roller 22. In the image heating apparatus 7, the pressing roller 22 and the fixing film 21 heated by the heater 23 with the temperature thereof adjusted to a predetermined fixing temperature rotate to sandwich the recording material P between the pressing roller 22 and the fixing film 21 and covey the recording material P through the fixing nip portion N, thus fixing the unfixed toner image T to the recording material P.

The heater holder 24 is formed of a highly heat resistant resin such as a liquid crystal polymer (LCP), polyphenylene sulfide (PPS), polyether ether ketone (PEEK) or a composite material of any of these resins and glass fiber, metal, ceramics, or the like. In the present embodiment, the LCP mixed with glass fiber was used.

The image heating apparatus 7 further has a flange 25 serving as a member that regulates opposite ends of the fixing film 21 in the axial directions. The flange 25 is arranged at each of the opposite ends of the heater holder 24 in the axial directions of the fixing film 21 to hold the fixing film 21 so that the fixing film 21 can rotate around the heater holder 24, while regulating the position of the fixing film 21 in the axial directions. Like the heater holder 24, the flange 25 is formed of the highly heat resistant resin or the composite material. In the present embodiment, PPS was used.

The image heating apparatus 7 further includes a metal stay 26 serving to prevent the heater holder 24 from being deflected in a longitudinal direction in order to allow the fixing nip portion N to be reliably formed by the heater holder 24 via the pressing roller 22 and the fixing film 21. The metal stay 26 needs to be rigid and is formed of iron, stainless steel (SUS), or the like so as to have a semi-elliptical cross section in the present embodiment.

The fixing film 21 is a composite film including a base layer of resin or metal and a release layer serving as a front layer and formed of a fluorocarbon resin or the like which has high releasability, in order to have a reduced heat capacity to allow quick start. Examples of the resin base layer include polyimide (PI), polyamideimide (PAI), PEEK, polyether sulfon (PES), and PPS which are set to at most 100 μm, preferably at most 70 μm and at least 40 m in film thickness. Examples of the metal base layer include SUS which are set to at most 50 μm and at least 15 μm in film thickness. Examples of the release layer include a tetrafluoroetylene perfluoro alkylvinylether copolymer (PFA), polytetra fluoroethylene (PTFE), and a fluorinated ethylene-propylene copolymer (FEP).

The fixing film 21 may include an elastic layer formed between the base layer and the release layer and including heat resistant rubber such as silicone rubber or fluorocarbon rubber. The fixing film 21 used in the present embodiment included the base layer of PI with an inner diameter of 18 mm and a film thickness of 60 μm which was coated with PFA provided with conductivity and serving as the release layer. The reason for the use of PFA provided with conductivity as the release layer is to avoid a fixing offset phenomenon that is common to electrophotographic apparatuses using dry toner and to restrain the surfaces of the fixing film 21 and the pressing roller 22 from being charged when the fixing film 21 and the pressing roller 22 rotate in contact with each other. The offset suppression means may involve applying a potential difference (electric field) between the surfaces of the fixing film 21 and the pressing roller 22 to avoid the offset phenomenon.

The heater 23 includes a heating element substrate 23-*a*, the energization heating resistance layer 23-*b* formed on the substrate, and an overcoat layer 23-*c* formed on the substrate so as to cover the energization heating resistance layer 23-*b*. As the heating element substrate 23-*a*, a ceramics material such as alumina or aluminum nitride is used which has heat resistance or an insulating property. The overcoat layer 23-*c* is formed in order to ensure an electric insulating property and to allow the heater 23 to slide on the inner peripheral surface of the fixing film 21.

In the present embodiment, a resistance paste including a mixture of silver and palladium and serving as the energization heating resistance layer 23-*b* having a width 1 mm was applied to an alumina substrate having a width of 7 mm, a length of 270 mm, and a thickness of 1 mm and serving as the substrate 23-*a*. The resultant structure was burned so as to have a resistance value of 13.3Ω at normal temperature. The overcoat layer 23-*c* was formed of heat-resistant glass with a thickness of approximately 50 μm. To allow the fixing film 21 and the heater 23 to appropriately slide on each other, an appropriate amount of Molykote specialty lubricant HP-300 GREASE manufactured by Dow Corning Toray was applied to the fixing film 21 and the heater 23 as sliding grease formed of a fluorocarbon resin.

A thermistor (temperature detecting section) 27 that serves as temperature detection means for detecting the temperature is in abutting contact with the heater 23. The thermistor 27 is provided in a sheet feeding area on a back surface of the heater 23 (the surface opposite to the surface of the heater 23 in contact with the fixing film 21). The energization of the energization heating resistance layer 23-*b* is controlled by a signal transmitted by the control circuit section 200. Furthermore, a safety element 28 is installed which turns off the energization of the energization heating resistance layer 23-*b* to ensure safety when the heater 23 is uncontrollable with the temperature thereof abnormally raised. The safety element 28 includes a thermo protector such as a temperature fuse or a thermo switch which is interposed in series with an energization circuit in the heater 23, in order to reliably ensure safety.

The pressing roller 22 includes a core metal 22-*a*, an elastic layer 22-*b* located outside the core metal 22-*a*, and a release layer 22-*c* that is the outermost layer. The pressing roller 22 comes into pressure contact with the heater 23 so as to sandwich the fixing film 21 between the pressing roller 22 and the heater 23 in an area where the pressing roller 22 is opposite to the heater 23. Thus, the fixing nip portion N with a predetermined width is formed between the pressing roller 22 and the fixing film 21 in the recording material P conveying direction. The pressing roller 22 is then rotationally driven counterclockwise by a pressing roller driving gear 30 fitted over the core metal 22-*a* so that the frictional force exerted between the pressing roller 22 and the fixing film 21 causes the fixing film 21 to rotate clockwise in conjunction with the rotation of the pressing roller 22.

In the present embodiment, the core metal 22-*a* was a free-cutting steel material (SUM material or the like) having an outer diameter of 13 mm and subjected to rust proofing, and the elastic layer 22-*b* was obtained by casting silicone rubber into a mold so that the layer was approximately 3.5 mm in thickness. The release layer 22-*c* that was the outermost layer with which the elastic layer 22-*b* was coated was obtained by extruding PAF, which is a fluorocarbon resin excellent in release property, into a tubular form with a thickness of approximately 50 μm. The pressing roller 22 used in the present embodiment had a product outer diameter of approximately 20 mm and a product hardness of 55° (Asker-C 1 kg load). The pressing roller 22 was pressed against the fixing film 21 by a pressing spring 29 via the flange 25, the metal stay 26, the heater holder 24, and the heater 23 under a force equivalent to a total pressure of 156.8 N, to form the fixing nip portion N.

(Heater Control)

The heater 23 as a whole is increased in temperature when an AC voltage is applied to a feeding electrode not depicted in the drawings to rapidly raise the temperature of the energization heating resistance layer (heating resistor) 23-*b*. This temperature rise state is detected by the thermistor 27, and an output from the thermistor 27 is subjected to an A/D conversion, with the resultant output loaded into the control circuit section 200. The control circuit section 200 gives an instruction based on the loaded information to control power supplied to the energization heating resistance layer 23-*b* under energization control such as phase control or wave number control. Thus, the heater 23 is controlled at a desired fixing temperature adjustment temperature.

When the image forming apparatus 100 receives an image forming signal from a personal computer 400 or the like, the heater 23, controlled by the control circuit section 200, starts raising the temperature, and substantially at the same time, the pressing roller 22 is rotationally driven. The fixing film 21 is driven by the pressing roller 22 to rotate at a speed equal to the speed of the pressing roller 22. In this state, with the expectation that the temperature detected by the thermistor 27 is equal to the fixing temperature adjustment temperature (target temperature), the electrophotographic process is started, and the recording material P on which the unfixed toner image T has been transferred and formed is guided by the fixing inlet guide 53 and conveyed to the fixing nip portion N. For the fixing temperature adjustment temperature at which fixing can be performed, when, for example, A4-sized sheets of ordinary paper with a basis weight of 70 g/m$^2$ are used, energization control is performed on the energization heating resistance layer 23-*b* such that the temperature detected by the thermistor 27 is between 200° C. and 185° C.

The reason why the fixing temperature adjustment temperature is unfixed and ranges from 200° C. to 185° C. is as follows. The members of the film image heating apparatus 7 are configured to have as low a heat capacity as possible in order to enable quick start. Thus, as a series of fixing operations is performed, each of the members of the image heating apparatus 7 has its temperature raised to cause excessive fixing as the execution of the fixing progresses. Thus, control is performed so as to, for example, lower the fixing temperature adjustment temperature in a step-by-step manner in accordance with the number of recording materials P on which the fixing has been performed. Furthermore, for a similar purpose, temperature control in accordance with the temperature detected by the thermistor 27 is generally performed when the execution of the heated fixing is started. For example, when a high temperature is detected, the image heating apparatus 7 is determined to be in a heated state, and the fixing temperature adjustment temperature is set to a low temperature. In contrast, when a low temperature is detected when the fixing is started, the image heating apparatus 7 is determined to be cooled, and the fixing temperature adjustment temperature is set to a high temperature. The detailed description of contents of the control is omitted. The present embodiment uses a control method described in Japanese Patent Application Laid-open No. H07-248700.

(Mechanism of Dew Condensation Slip)

Before description of a method for suppressing dew condensation slip which is characteristic of the present invention, the phenomenon and mechanism of dew condensation slip will be described in detail. Defect phenomena resulting from dew condensation slip are as follows. When the fixing film 21 is decelerated or stopped with a sheet interval set for a case where image formation is performed by consecutively conveying a plurality of recording materials, only the fixing nip portion of the fixing film 21 is heated more than needed before a subsequent recording material is conveyed to the fixing nip portion. Then, "gloss unevenness" that is an image defect caused by excessive fixing occurs in a portion of the subsequent recording material with which the portion of the fixing film which has been heated more than needed comes into contact. When gloss unevenness occurs, the fixing film rotates unstably between the sheets, but the recording materials can be conveyed. The sheet interval as used herein refers to the conveying interval between preceding and subsequent recording materials.

When the dew condensation slip is further deteriorated beyond the level of the gloss unevenness, the recording material conveyed to the fixing nip portion is more unstably conveyed, causing the recording material to be deflected. The recording material having passed though the transfer nip portion is conveyed at a predetermined conveying speed, "image rubbing" or "paper folding" may occur; in the "image rubbing", the unfixed image is rubbed by various members in the apparatus or the image heating apparatus, and the "paper folding" is a phenomenon in which the recording material is folded (in Z form). When the dew condensation slip is further deteriorated beyond the level of the image rubbing or the paper folding and the rotation of the fixing film is stopped, a "jam" of the recording material that is common to image forming apparatuses occurs as a paper jam in the fixing nip portion. The level of the defects resulting from the dew condensation slip increases in an order of "gloss unevenness", "image rubbing" or "paper folding", and "jam". The dew condensation slip is caused by steam generated by the preceding recording material, and thus does not occur when image formation is performed only on one sheet.

Such dew condensation slip is likely to occur when the amount of steam generated by the recording material increases or when the pressing roller is so cold that more steam adheres to the pressing roller. First, the steam generated by the recording material will be described. The steam is generated when the temperature of moisture contained in the recording material is raised at the fixing nip portion, and results from absorption, by the recording material, of humidity in the environment in which the apparatus is installed. The amount of moisture that can be present as steam in the environment in which the apparatus is installed increases consistently with the temperature in the environment (with the amount of saturated steam). The amount of moisture absorbed by the recording material or the water content of the recording material increases consistently with humidity. The water content of the recording material can be measured using a water content meter. For example, Moistrex MX-8000 from NDC Infrared Engineering Ltd (Britain) can be used for measurement. The amount of dew adhering to the surface of the pressing roller decreases consistently with the amount of moisture contained in the recording material. The amount of dew adhering to the surface of the pressing roller increases consistently with the amount of moisture contained in the recording material, resulting in severe dew condensation slip.

Furthermore, besides the water content of the recording material, the cause of easy adhesion of steam to the pressing roller surface is a low pressing roller surface temperature or a solid image formed all over the recording material. More steam adheres to the pressing roller surface in the case of a solid image because a toner image is formed on the fixing film side of the recording material to occlude an outlet for the steam, with the result that most of the generated steam is emitted to the pressing roller side. For example, in the case of a solid image such as a photograph, illustration, or a graph, the outlet for steam from the recording material is occluded by the toner image formed like a surface on the fixing film side. The solid image occluding the escapeway for the steam generated from the print surface side of the recording material increases the amount of steam adhering to the pressing roller surface, leading to severe dew condensation slip.

(Suppression Control of Dew Condensation Slip)

In the embodiment of the present invention, suppression control of dew condensation slip is performed in accordance with the "printing rate" or the "temperature and humidity in the environment in which the apparatus is placed", which significantly affects the dew condensation slip. Specifically, in the present embodiment, in consecutive image formation in which at least two consecutive images are formed, the control circuit section 200 calculates and acquires the printing rate, the rate of the toner image T in the recording material P, as image information. Then, when dew condensation slip is expected to occur based on the printing rate of the preceding recording material P, control is performed so as to delay conveyance timings for the second and subsequent recording materials P to be conveyed. Thus, the surface temperature of the pressing roller 22 is raised to evaporate and vaporize the dew on the surface of the pressing roller 22 to enable suppression of dew condensation slip that is expected to occur in association with the subsequent recording material P.

First, the results of examination of the effects of the printing rate and the temperature and humidity of the environment on the dew condensation slip in the image forming apparatus 100 used in the present embodiment will be described. The image forming apparatus 100 used for the examinations is as described above, and the other conditions are the same as those described below.

The recording material P is CS-680 (manufactured by Canon Marketing Japan Inc.), and the environment is a high-temperature and high-humidity environment with a temperature of 30° C. and a humidity of 80%. The recording material P is left untouched in this environment for 48 hours so as to have a water content of 9.2 to 9.9% and 9.6% on average.

Five types of images with different printing rates are used.

Image-A (no printing, solid white image)

Image-B (image with a printing rate of 4% specified in ISO/IEC 19752)

Image-C (entire halftone image with a printing rate of 25%)

Image-D (entire halftone image with a printing rate of 50%)

Image-E (entire solid black image with a printing rate of 100%)

Under each of these conditions, at a timing when the temperature detected by the thermistor 27 in contact with the heater 23 reached 30° C., the effect of the printing rate on the dew condensation slip was examined by feeding 10 consecutive sheets for evaluation.

Table 1 depicts results of the examinations. Numerical values in the table represent the number of the page on which defect starts to appear. "4" indicates that a defect starts to occur on the fourth page. A smaller number indicates that a defect starts to occur on an earlier page, and this means a worse level.

TABLE 1

| Image | Printing rate (%) | Gloss unevenness | Image rubbing/paper folding | Jam |
|---|---|---|---|---|
| A | 0 | ○ | ○ | ○ |
| B | 4 | ○ | ○ | ○ |
| C | 25 | ○ | ○ | ○ |
| D | 50 | 4 | 7 | ○ |
| E | 100 | 2 | 3 | 3 |

As in the results depicted in Table 1, no defect was observed on the images A, B, and C with low printing rates. However, a defect started to occur on the images D and E with increased printing rates. Even a jam occurred in the case of the image E.

Now, the results of examinations of the effects of the temperature and humidity in the environment in which the apparatus is installed are illustrated. The conditions were such that the image E with severe dew condensation slip was used and that the occurrence of the dew condensation slip was examined with changes in the temperature and humidity in the environment in which the apparatus was placed. The conditions for the water content of the recording material were such that paper was left untouched in the environment with the temperature and humidity depicted in Table for 48 hours and that the recording materials P were used immediately after unpackaging at 26° C./70%, which is expected to correspond to an average office environment. The results are depicted in Table 2, along with the water contents of the recording materials P under the above-described conditions. The conditions other than the environment and the image are the same as the above-described conditions.

TABLE 2

| Environmental condition temperature (° C.) and humidity | Paper condition | Water content (%) | Examination results: Gloss unevenness | Image rubbing/paper folding | Jam |
|---|---|---|---|---|---|
| 20/50 | Left untouched | 6.2 | ○ | ○ | ○ |
| 24/50 | Left untouched | 6.5 | ○ | ○ | ○ |
| 26/70 | Immediately after unpackaging | 5.8 | ○ | ○ | ○ |
| | Left untouched | 7.8 | 6 | ○ | ○ |
| 28/80 | Left untouched | 8.7 | 4 | 7 | ○ |
| 30/80 | Left untouched | 9.6 | 2 | 3 | 3 |
| 35/85 | Left untouched | 10.4 | 2 | 2 | 3 |

As depicted in Table 2, in connection with the water content of the recording material P, a jam may occur at a high water content, but no defect resulting from the dew condensation slip occurs at a low water content. As described above, the image forming apparatus 100 used in the present embodiment has the temperature and humidity sensor 9 serving as an environment detecting sensor that can detect the temperature and humidity in the environment in which the apparatus is placed. The condition is set such that counter control described below is performed when the apparatus is used in an environment exceeding 25° C./60% based on the information from the temperature and humidity sensor 9. Thus, the occurrence of dew condensation slip is affected by the printing rate of an image formed and the water content of the recording material P.

Now, the effect, on the dew condensation slip, of the printing rate, that is, the range of the image in the recording material P, will be described. In the present embodiment, the rate (printing rate) of the size of a formed image in the size of the image formable area on the recording material P is considered in connection with a forward range (front half portion) of the image formable area on the recording material P with respect to the center of the area in the conveying direction and a rearward range (rear half portion) of the image formable area on the recording material P with respect to the center of the area in the conveying direction. Specifically, even when a solid image, which is very likely to cause the dew condensation slip, is formed in the front half portion of the recording material P, if the rear half portion is not printed, then steam is condensed on the pressing roller 22 surface via the front half portion, but, a reduced amount of steam is generated from the pressing roller 22 side via the rear half portion. As a result, the steam condensed on the pressing roller 22 surface via the front half portion can be evaporated and vaporized, and the dew condensation slip is unlikely to occur. On the other hand, when a solid image, which is very likely to cause the dew condensation slip, is formed in the rear half portion of the recording material P, the sheet interval portion or the subsequent recording material P is conveyed without mitigation of the state where steam is condensed on the pressing roller 22 surface. Thus, the force with which the fixing film 21 or the recording material P is conveyed decreases to increase the likelihood of the dew condensation slip.

Even when the front half portion of the recording material is printed at a high printing rate and a large amount of steam is generated from the pressing roller 22 side of the recording material, condensation is unlikely to occur on the surface of the pressing roller 22. This is because, before printing of the recording material is performed and when the sheet interval is located at the nip portion, the surface of the pressing roller 22 has been warmed by heat fed from the film 21. However, when the rear half portion of the recording material passes through the nip portion, the heat on the surface of the pressing roller 22 is drawn by the recording material, and the temperature of the surface decreases. Therefore, when the rear half portion of the recording material is printed at a high printing rate and a large amount of steam is generated from the pressing roller 22 side of the recording material, condensation is likely to occur on the surface of the pressing roller 22.

Figure 9:
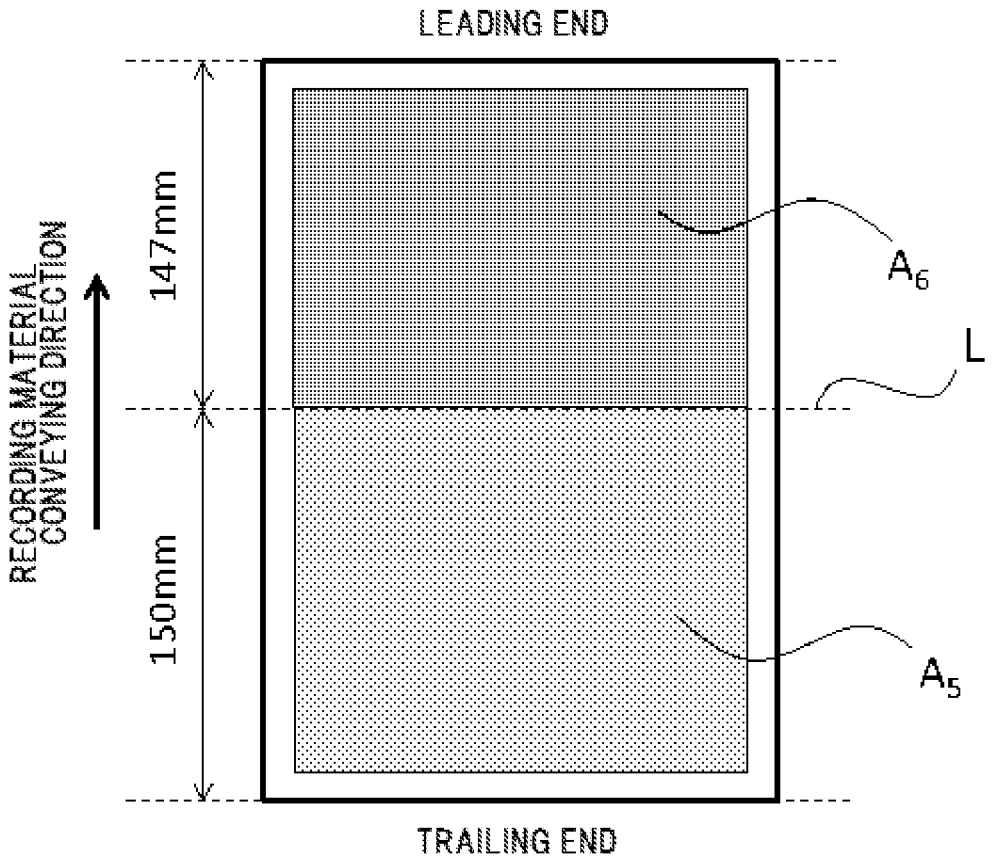
FIG. 9 is a diaphragm depicting a front half and a rear half of the recording material according to Embodiment 1.

To examine this, an A4-sized sheet with a length of 297 mm used as the recording material P is divided at a line L into a 147-mm portion on the leading end side of the recording material as the front half portion (area $A_6$) and a 150-mm portion on the trailing end side of the recording material as the rear half portion (area $A_5$) in the recording material P conveying direction as depicted in FIG. 9. Then, the printing rate of each of the ranges (area $A_5$ and area $A_6$) is varied to examine the effect of the printing rate on the dew condensation slip. The results of the examination will be described. The conditions used for the examination are as follows. For the environment and the recording material, the recording material was left untouched in the environment of 30° C./80% for 48 hours so as to have a high water content of 9.6%. Images with different printing rates were combined together as the front half portion and the rear half portion. Thus, the dew condensation slip was examined. The results of the examination are depicted in Table 3.

TABLE 3

| Printing rate (%) | | Dew condensation slip | | |
|---|---|---|---|---|
| | | | Image | |
| Front half portion | Rear half portion | Gloss unevenness | rubbing/paper folding | Jam |
| 100 | 100 | 2 | 3 | 3 |
| | 50 | 4 | ○ | ○ |
| | 25 | ○ | ○ | ○ |
| 50 | 100 | 2 | 4 | 4 |
| | 50 | 4 | 7 | ○ |
| | 25 | ○ | ○ | ○ |
| 25 | 100 | 3 | 4 | 4 |
| | 50 | 5 | 7 | ○ |
| | 25 | 8 | ○ | ○ |
| 0 | 100 | 5 | 7 | ○ |
| | 50 | 6 | ○ | ○ |
| | 25 | ○ | ○ | ○ |

As in the results depicted in Table 3, the occurrence of the dew condensation slip is affected more significantly by the printing rate of the rear half portion of the recording material P than by the printing rate of the front half portion. In the present embodiment, a condition for performing counter control described below is such that, as the printing rate of the rear half portion of the recording material P which exceeds 25%, a printing rate of 30% has been calculated.

(Verification of the Effect)

Tables 4A to 4C depict the results of verification of the effect proposed in the present embodiment and which, when consecutive image formation is performed and the rear half portion of the recording material P has a higher printing rate, delays the conveying timing for the subsequent recording material P to extend the sheet interval to allow an increase in pressing roller 22 surface temperature. Conditions used for the verification are such that the temperature and humidity of the environment was set to 26° C./70%, 28° C./80%, 30° C./80%, and 32° C./85% and such that paper used was left untouched in these environments for 48 hours. The printing rate was fixed at 100% for the front half portion and varied among 100%, 75%, 50%, and 25% for the rear half portion. For the delay of the conveying timing (sheet interval) for the subsequent recording material P, which is characteristic of the present invention, the sheet interval was set to 55 mm and 70 mm compared to the normal sheet interval of 27 mm, and extended until defects resulting from the dew condensation slip were eliminated. Tables 4A to 4C depict the results of comparison and verification of a comparative example in which the sheet interval was not extended and the embodiment of the present invention in which the sheet interval was extended.

TABLE 4A

| Temperature | Rear half | Comparative example Sheet interval (mm) 27 | | |
|---|---|---|---|---|
| and humidity (° C./%) | portion printing rate (%) | Gloss unevenness | Image rubbing/paper folding | Jam |
| 26/70 | 100 | 6 | ○ | ○ |
| | 75 | ○ | ○ | ○ |
| 28/80 | 100 | 4 | 7 | ○ |
| | 75 | 5 | ○ | ○ |
| | 50 | ○ | ○ | ○ |
| 30/80 | 100 | 2 | 3 | 3 |
| | 75 | 3 | 5 | ○ |

TABLE 4A-continued

| Temperature and humidity (° C./%) | Rear half portion printing rate (%) | Comparative example Sheet interval (mm) 27 Gloss unevenness | Image rubbing/paper folding | Jam |
|---|---|---|---|---|
| | 50 | 5 | 7 | ○ |
| | 25 | ○ | ○ | ○ |
| 32/85 | 100 | 2 | 2 | 3 |
| | 75 | 2 | 3 | 5 |
| | 50 | 3 | 5 | ○ |
| | 25 | ○ | ○ | ○ |

TABLE 4B

| Temperature and humidity (° C./%) | Rear half portion printing rate (%) | Embodiment Sheet interval (mm) 55 Gloss unevenness | Image rubbing/paper folding | Jam |
|---|---|---|---|---|
| 26/70 | 100 | ○ | ○ | ○ |
| | 75 | ○ | ○ | ○ |
| 28/80 | 100 | 6 | 8 | ○ |
| | 75 | ○ | ○ | ○ |
| | 50 | ○ | ○ | ○ |
| 30/80 | 100 | 4 | 6 | ○ |
| | 75 | 5 | 8 | ○ |
| | 50 | ○ | ○ | ○ |
| | 25 | ○ | ○ | ○ |
| 32/85 | 100 | 3 | 5 | ○ |
| | 75 | 4 | 7 | ○ |
| | 50 | 6 | ○ | ○ |
| | 25 | ○ | ○ | ○ |

TABLE 4C

| Temperature and humidity (° C./%) | Rear half portion printing rate (%) | Embodiment Sheet interval (mm) 70 Gloss unevenness | Image rubbing/paper folding | Jam |
|---|---|---|---|---|
| 26/70 | 100 | — | — | — |
| | 75 | — | — | — |
| 28/80 | 100 | ○ | ○ | ○ |
| | 75 | — | — | — |
| | 50 | — | — | — |
| 30/80 | 100 | ○ | ○ | ○ |
| | 75 | ○ | ○ | ○ |
| | 50 | — | — | — |
| | 25 | — | — | — |
| 32/85 | 100 | ○ | ○ | ○ |
| | 75 | ○ | ○ | ○ |
| | 50 | ○ | ○ | ○ |
| | 25 | — | — | — |

With the sheet interval of 27 mm depicted in the comparative example in Tables 4A to 4C, the dew condensation slip is unlikely to occur regardless of the temperature and humidity of the environment when the printing rate of the rear half portion is low and 25%, but the likelihood of the dew condensation slip increases consistently with the printing rate. Even in this state, substantially all the dew condensation slip cases can be dealt with by performing control that extends the sheet interval as proposed in the present embodiment to extend the sheet interval to 55 mm and further to 70 mm.

Now, the effect of extension of the sheet interval from the normal value of 27 mm to 55 mm or 70 mm to allow the dew condensation slip to be avoided will be described. To allow evaporation and vaporization of moisture, such as water droplets condensed on the pressing roller 22 surface, which may cause the dew condensation slip, in use of the fixing nip portion N, the entire periphery of the pressing roller 22 needs to pass through the fixing nip portion N to raise the temperature while the sheet interval is located at the fixing nip portion N. The pressing roller 22 used in the present embodiment has an outer diameter of approximately 20 mm and thus has a peripheral length of approximately 63 mm. Thus, to allow the entire periphery of the pressing roller 22 to pass through the fixing nip portion N while the sheet interval is located at the fixing nip portion N, the sheet interval needs to be at least 63 mm. The results in Tables 4A to 4C indicate that defects can be eliminated even when the sheet interval is 55 mm, which is shorter than 63 mm, if the dew condensation slip, which occurs in association with the printing rate of the rear half portion of the recording material P and the temperature and humidity of the environment, is at a good level but that the sheet interval of 55 mm is insufficient if the dew condensation slip is at a bad level. Therefore, when the sheet interval is set at least to 70 mm, which is longer than the peripheral length of 63 mm of the pressing roller 22, the temperature can be raised enough to reliably evaporate and vaporize moisture condensed on the pressing roller 22 surface, thus enabling the dew condensation slip to be suppressed.

Figure 5:
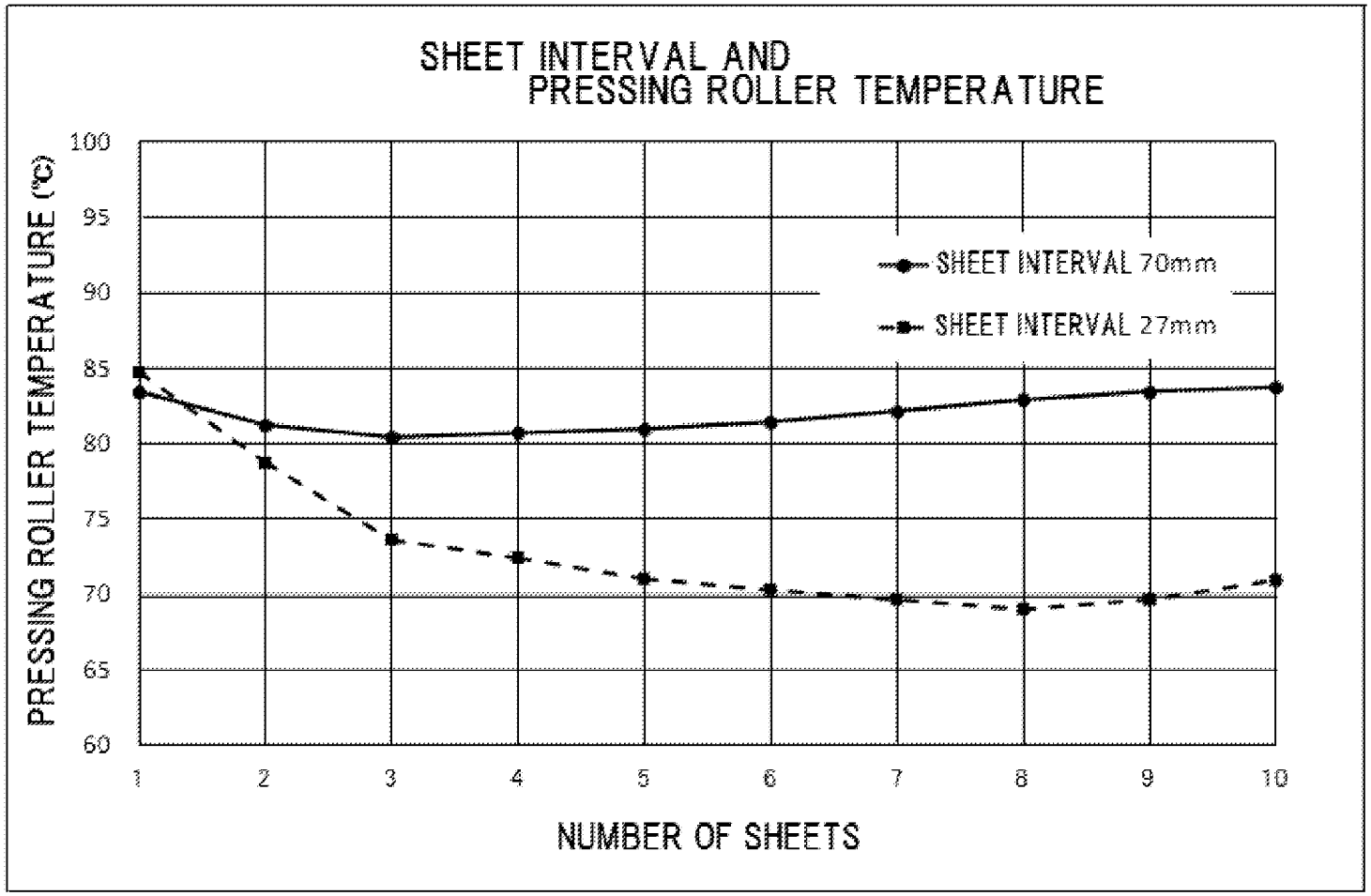
FIG. 5 is a diagram illustrating the relation between a sheet interval and the ramp rate of a surface of a pressing roller.

FIG. 5 depicts the results of measurement of differences in increase in the temperature of the pressing roller 22 resulting from differences in sheet interval. The surface temperature of the pressing roller 22 is the temperature measured by bringing a thermocouple into contact with the pressing roller 22 surface. As depicted in FIG. 5, the surface temperature of the pressing roller 22 fails to be raised at the normal sheet interval of 27 mm. In contrast, when the counter control in the present embodiment is performed to extend the sheet interval to 70 mm, the entire periphery of the pressing roller 22 passes through the fixing nip portion N while the sheet interval is located at the fixing nip portion N. This suppresses a decrease in the surface temperature of the pressing roller 22 and allows an increase in the surface temperature. As a result, the image heating apparatus 7 used in the present embodiment enables maintenance of a pressing roller 22 temperature of at least 80° C., which is higher than the pressing roller 22 temperature corresponding to the second sheet on which gloss unevenness occurs; the gloss unevenness results from the dew condensation slip and occurred in the comparative example illustrated in Tables 1 to 4. Therefore, the image heating apparatus 7 allows defects resulting from the dew condensation slip to be eliminated. The pressing roller 22 temperature at which a defect resulting from the dew condensation slip occurs varies depending on the image heating apparatus 7 adopted.

(Dew Condensation Slip Suppression Control Flow)

Figure 1:
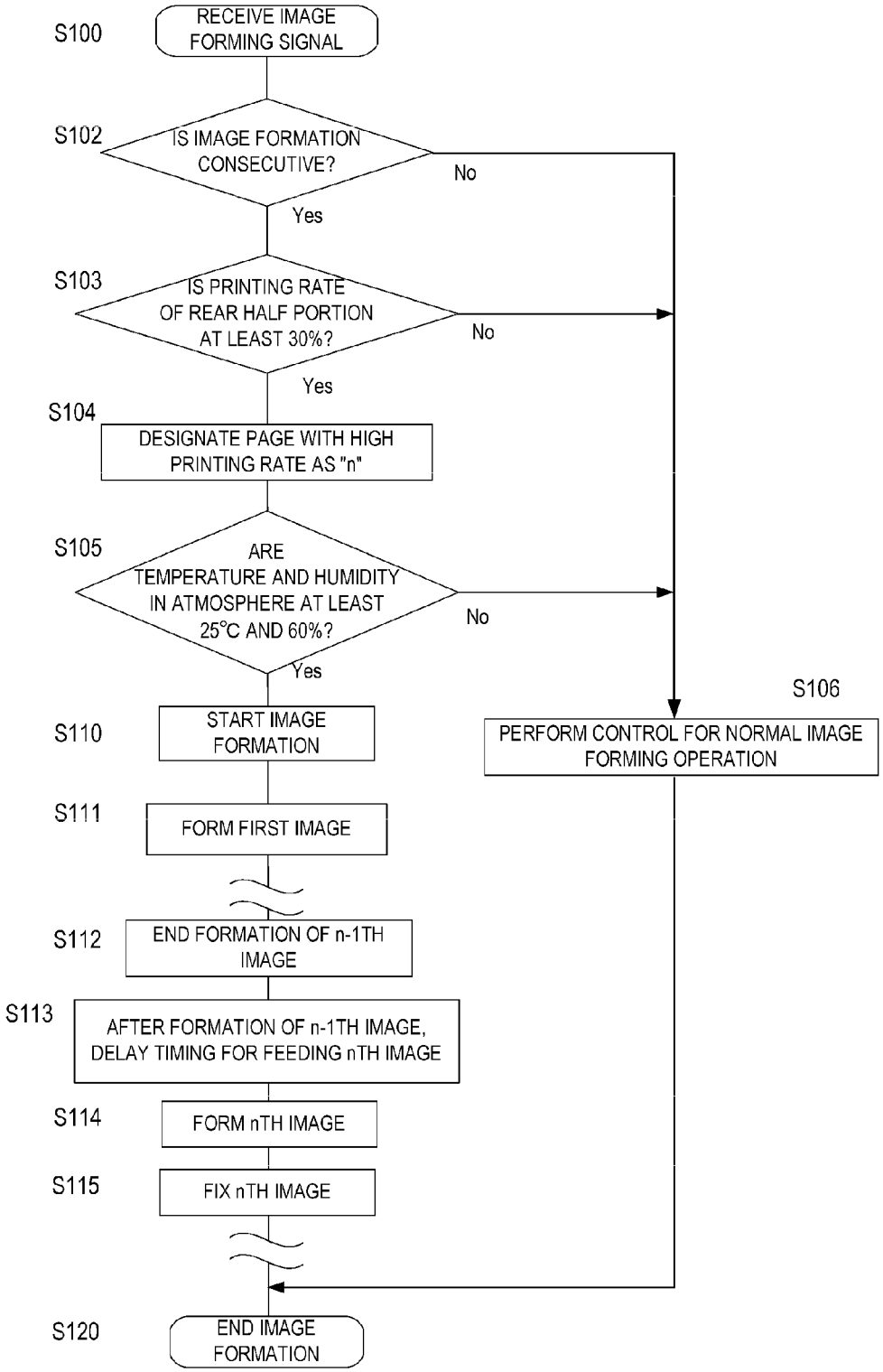
FIG. 1 is a flowchart of condensation slip suppression control according to Embodiment 1.

FIG. 1 depicts, in a flowchart, the flow of suppression control of the dew condensation slip as proposed in the present embodiment. As depicted in FIG. 1, upon receiving an image forming signal (S100), the control circuit section 200 determines the number of images formed (the number of sheets printed), that is, whether one image is formed or at least two images are consecutively formed (S102). When one image is formed (S102, No), the control circuit section 200 determines a normal image forming operation to be performed and correspondingly controls the components of the image forming apparatus 100 (S106). The control circuit section 200 then ends the image formation (S120).

When at least two images are consecutively formed (S102, Yes), the control circuit section 200 serves as an acquisition portion to calculate and acquire the printing rate of the rear half portion (predetermined area) of an image formed on the recording material P, from the received image information. The control circuit section 200 then determines whether or not the printing rate acquired exceeds a predetermined printing rate (threshold) for each page (S103). In the present embodiment, the threshold was set to 30%. When none of the pages has a high printing rate (recording material with a high rate) (S103, No), the control circuit section 200 determines a normal image forming operation to be performed and correspondingly controls the components of the image forming apparatus 100 (S106). The control circuit section 200 then ends the image formation (S120). If any of the pages has a high printing rate (recording material with a high rate) (S103, Yes), the control circuit section 200 stores the page with the high printing rate in a storage section as "n" (S104).

Subsequently, the control circuit section 200 acquires the temperature and humidity inside the image forming apparatus detected by the temperature and humidity sensor (humidity detecting portion) 9 to determine whether or not the image forming apparatus is in a predetermined atmospheric environment, that is, whether or not the temperature and the humidity exceed respective predetermined values (S105). In the present embodiment, the control circuit section 200 determined whether or not the temperature and the humidity were equal to or higher than 25° C./60%. When the image forming apparatus is not in the predetermined atmospheric environment (S105, No), the control circuit section 200 determines a normal image forming operation to be performed and correspondingly controls the components of the image forming apparatus 100 (S106). The control circuit section 200 then ends the image formation (S120).

When the image forming apparatus is in the predetermined atmospheric environment (S105, Yes), the control circuit section 200 serves as a control portion that controls the conveyance interval for recording materials for consecutive image formation (consecutive printing) to perform control that sets a conveying interval appropriate to suppress the dew condensation slip (S110 to S115). Specifically, the control circuit section 200 starts image formation (S110) and controls the conveyance interval so as to set the normal sheet interval for formation of the first image (S111) to formation of the n−1th image at the end of the image formation (S112). When formation of the n−1th image ends, the control circuit section 200 delays a conveyance timing for the subsequent nth image (the timing for feeding-out to the image forming portion) (S113). The control circuit section 200 performs control that changes the conveyance interval for the recording materials so that a predetermined interval is exceeded by the interval from passage of the preceding recording material (n−1th recording material) through the fixing nip portion N until the entry of the recording material with a high rate (n th recording material) into the fixing nip portion N.

In this regard, the predetermined interval is the interval from passage of a preceding recording material through the fixing nip portion N until the entry of the subsequent recording material into the fixing nip portion N when the moisture condensed on the outer peripheral surface of the pressing roller 22 (the surface in contact with the fixing film 21) can be evaporated. In the present embodiment, the predetermined interval is achieved by performing control so as to provide an interval that allows the entire outer peripheral surface of the pressing roller 22 to pass through the fixing nip portion N while the sheet interval is located at the fixing nip portion N. The control also involves providing an interval that allows the temperature to be raised enough to enable the moisture condensed on the entire outer peripheral surface of the pressing roller 22 to be evaporated.

In the present embodiment, the conveyance interval is set so as to set a distance (that is, a sheet interval) of 70 mm between the trailing end of the n−1th recording material (preceding recording material) and the leading end of the nth recording material (recording material with a high rate) in the recording material conveying direction. That is, control is performed so as to form the above-described conveyance interval by delaying the conveyance timing when the registration roller 52 feeds the nth recording material out to a transfer portion of the image forming portion, until after the conveyance timing for the n−1th recording material. The effect is produced at least as long as the interval for the entry into the fixing portion (interval for the entry into the fixing nip portion) exceeds the above-described predetermined interval. Therefore, for example, a conveying configuration that allows the timing for feeding-out to the transfer portion and the timing for feeding-out to the fixing portion to be individually controlled may be adopted.

The control circuit section 200 forms an image on the nth recording material for which the conveyance interval has been changed (S114) and fixes an unfixed toner image transferred onto the nth recording material (S115). For the conveyance timings for the recording materials subsequent to the nth recording material, control was performed in the present embodiment so as to delay the conveyance timing as is the case with the nth recording material. With the above-described control, the formation of images on all pages in consecutive image formation is ended (S120).

As described above, control is performed so as to delay the conveyance timing for the recording material P to extend the sheet interval in accordance with the printing rate and the temperature and humidity in the environment without setting, to standard (uniform) values, a pre-rotation time and a sheet interval time for the apparatus configuration which are needed to set the surface temperature of the pressing roller 22 to a value at which no condensation phenomenon occurs. Specifically, the conveyance timing for a subsequent recording material P is delayed to extend the sheet interval in accordance with the printing rate of the image formed on the rear half portion of the certain recording material P and the temperature and humidity in the environment only when steam generated from the preceding recording material P is condensed on the pressing roller 22 surface to cause the dew condensation slip. Thus, even when steam generated from the certain preceding recording material P is condensed on the pressing roller 22 surface, the pressing roller 22 surface temperature can be raised while the sheet interval between the certain recording material P and the subsequent recording material P is located at the fixing nip portion, allowing the steam condensed on the pressing roller 22 surface to be evaporated and vaporized. The above-described control allows possible dew condensation slip to be avoided without extending the FPOT or the sheet interval to the standard (uniform) value. Therefore, an image forming apparatus can be provided which enables both avoidance of the dew condensation slip and ensuring of a reduced FPOT and high productivity.

At a timing when the pressing roller 22 has a surface temperature at which the dew condensation slip is unlikely to occur, control can be performed which returns the sheet interval extended by delaying the conveyance timings (conveyance timings for the nth and subsequent recording materials) to the normal sheet interval. That is, when a predetermined period has elapsed since the entry of a recording material with a high printing rate into the fixing nip portion, control may be performed which avoids delaying the interval of entry into the fixing nip portion. In the present embodiment, given that the image heating apparatus 7 has an elevated temperature after 10 consecutive sheets fed in the verification example are fed, possible defects resulting from the dew condensation slip can be eliminated even when the sheet interval is returned to the normal interval. Furthermore, in the present embodiment, values for the image forming range and the printing rate within the image forming range specifically illustrated as conditions for reliably avoiding the dew condensation slip vary according to the specific apparatus configuration, the usage environment, or the like, and are designed as needed in accordance with specifications.

In the present embodiment, the predetermined area that is a part of the image formable area and from which the printing rate is to be acquired is the rear half portion ($A_5$) in FIG. 9. However, the present embodiment is not limited to this.

Figures 7A, 7B:
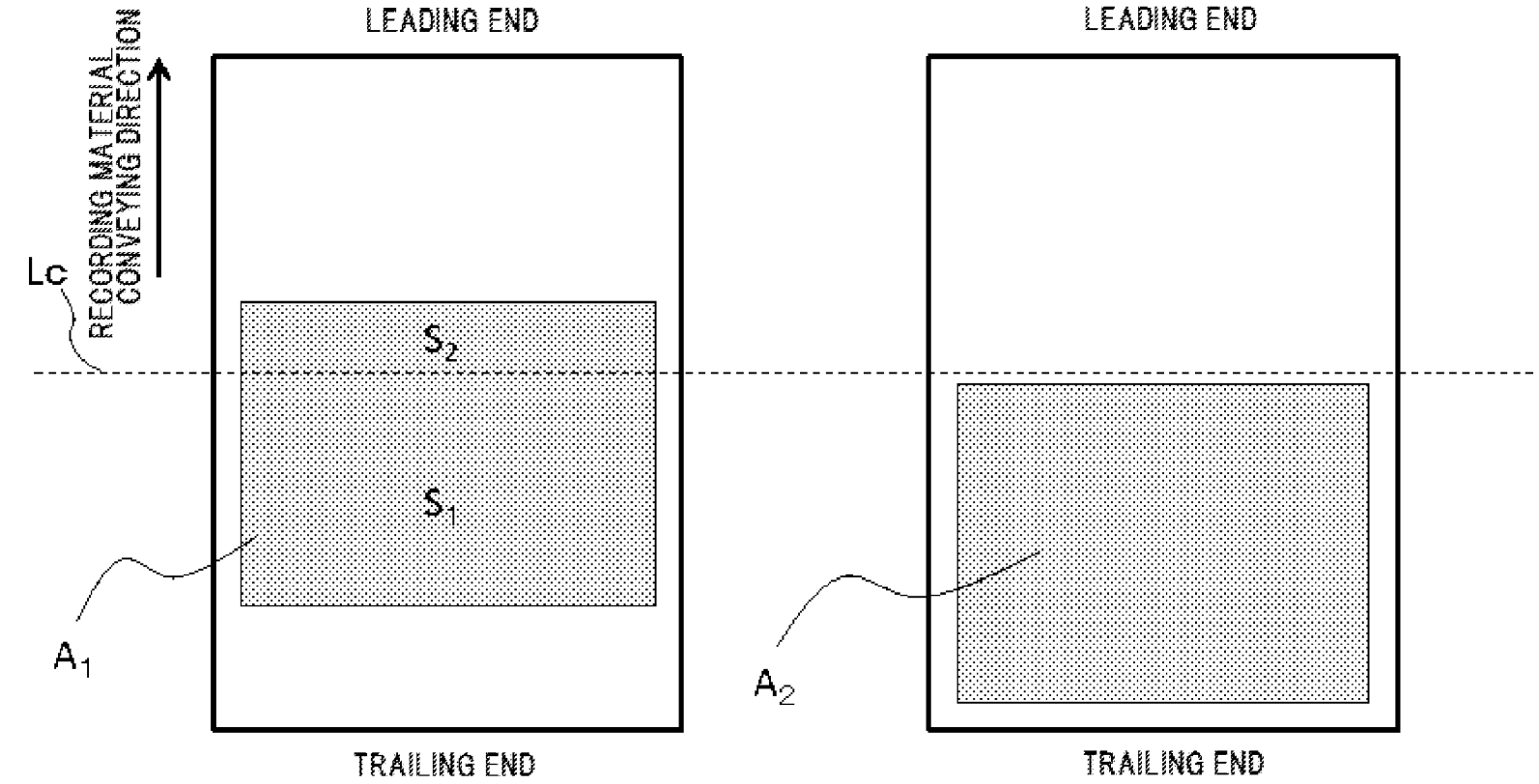
FIGS. 7A and 7B are diagrams depicting a predetermined area on a recording material for which a printing rate is acquired according to Embodiment 1.

Any predetermined area may be set as long as the size $S_1$ of the predetermined area on the trailing end side of the recording material is larger than the size $S_2$ of the predetermined area on the leading end side of the recording material with respect to the center (Lc) of the recording material in the recording material conveying direction as depicted in FIG. 7A. The rear half portion ($A_5$) in FIG. 9 also meets this definition. Alternatively, as depicted in FIG. 7B, the predetermined area may be an area provided only on the trailing end side of the recording material with respect to the center (Lc).

Figures 8A, 8B:
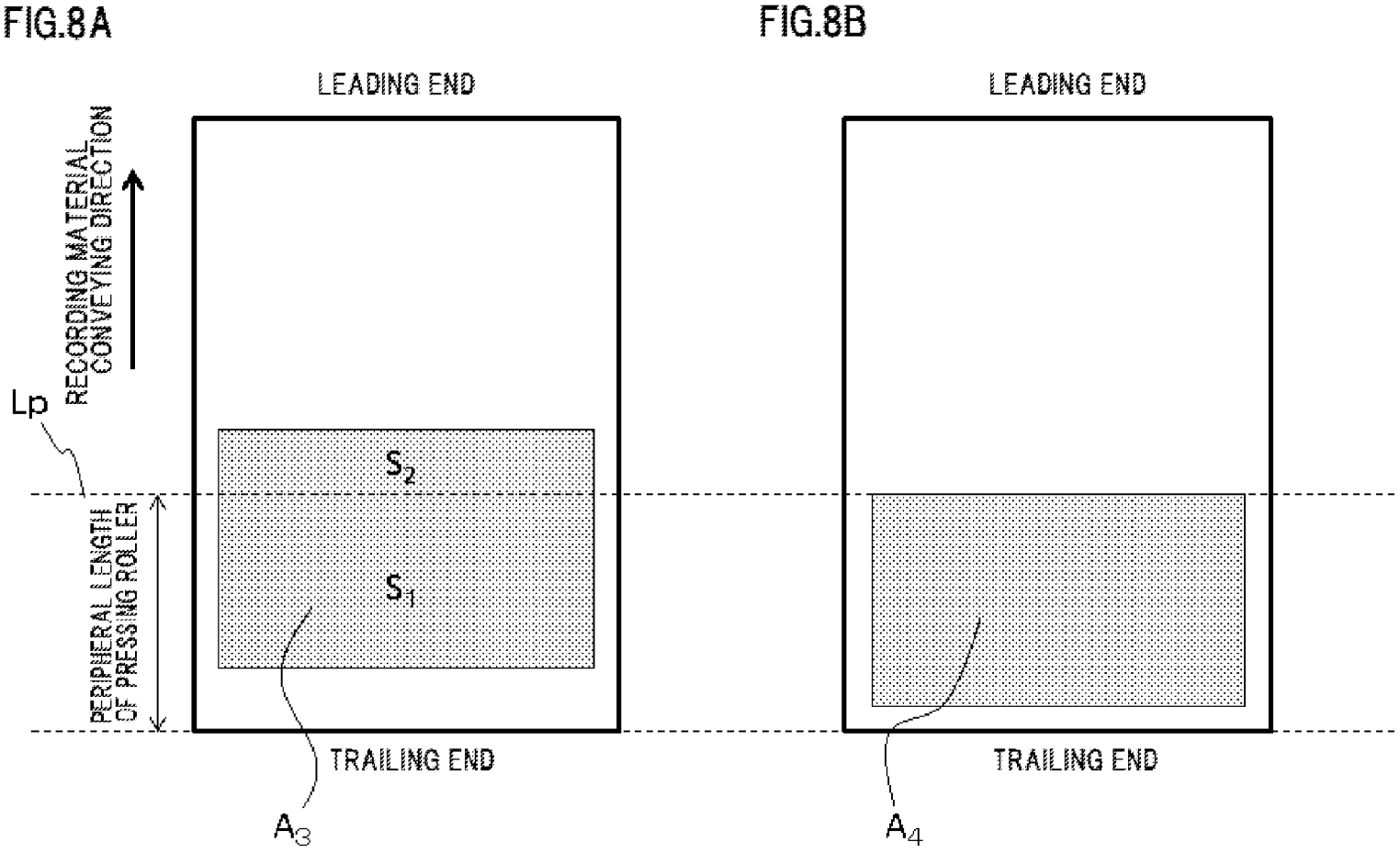
FIGS. 8A and 8B are diagrams depicting the predetermined area on the recording material for which the printing rate is acquired according to Embodiment 1.

In FIGS. 7A and 7B, the reference is set to be the center of the recording material. However, the present embodiment is not limited to this. The size $S_1$ of the predetermined area on the trailing end side of the recording material is preferably larger than the size $S_2$ of the predetermined area on the leading end side of the recording material with respect to a position (Lp) at a distance equal to the peripheral length of the pressing roller 22 from the trailing end of the recording material in the recording material conveying direction as depicted in FIG. 8A. Alternatively, the predetermined area may be an area provided only on the trailing end side of the recording material with respect to the position (Lp).

In the present embodiment, the temperature and humidity sensor 9 detects the temperature and humidity outside the apparatus (the temperature and humidity in the atmosphere), and both the temperature and the humidity are used to determine whether or not to extend the sheet interval. However, the humidity detected by the temperature and humidity sensor may exclusively be used to determine whether or not to extend the sheet interval. Furthermore, control may be performed so as to set the sheet interval longer when the printing rate of the predetermined area exceeds the threshold than when the printing rate of the predetermined area does not exceed the threshold, regardless of the detection result from the temperature and humidity sensor 9.

Embodiment 2

An image forming apparatus according to Embodiment 2 of the present invention will be described. In Embodiment 2, features of Embodiment 2 will be described, and components common to Embodiment 1 are denoted by the same reference numerals as those in Embodiment 1 and will not be described below. Even when the printing rate and the temperature and humidity meet the conditions for the occurrence of the dew condensation slip described in Embodiment 1, if the image heating apparatus 7 is sufficiently heated, the dew condensation slip may be prevented. That is, if image formation is performed when the pressing roller 22 has an elevated temperature, the surface temperature of the pressing roller 22 can be easily raised enough to prevent adhesion of moisture resulting from condensation, hindering possible dew condensation slip. Consequently, the delay control described in Embodiment 1 need not be performed. Thus, in Embodiment 2, the temperature elevation state of the image heating apparatus 7 is determined based on the temperature detected by the thermistor 27 in contact with the heater 23. When the image heating apparatus 7 is warmed, the delay control of the conveyance timing for the recording material P described in Embodiment 1 is not performed.

Tables 5A and 5B depict as temperature rise conditions of the image heating apparatus 7 the results of comparison and examination of the relation between the temperature detected by the thermistor 27 and the surface temperature of the pressing roller 22 at the beginning of image formation and defects resulting from the dew condensation slip. For conditions used for the examination, the image used was an image-E that was an entire solid image with a printing rate of 100%, and the environment was at 30° C./80%. The other conditions were the same as the corresponding conditions used in Embodiment 1. A comparative example in which the delay control was not performed and Embodiment 2 in which the delay control was performed were examined.

TABLE 5A

| | | Comparative example Sheet interval 27 (mm) | | |
|---|---|---|---|---|
| Thermistor temperature (° C.) | Pressing roller temperature (° C.) | Gloss unevenness | Image rubbing/paper folding | Jam |
| 30 | 30 | 2 | 3 | 3 |
| 50 | 35 | 4 | 5 | 5 |
| 80 | 55 | 7 | ○ | ○ |
| 100 | 65 | ○ | ○ | ○ |
| 120 | 70 | ○ | ○ | ○ |
| 150 | 90 | ○ | ○ | ○ |

TABLE 5B

| | | Embodiment 2 | |
|---|---|---|---|
| Thermistor temperature (° C.) | Pressing roller temperature (° C.) | Sheet interval 70 (mm) Dew condensation slip | Sheet interval 27(mm) Dew condensation slip |
| 30 | 30 | ○ | |
| 50 | 35 | ○ | |
| 80 | 55 | ○ | |
| 100 | 65 | ○ | ○ |
| 120 | 70 | | ○ |
| 150 | 90 | | ○ |

As depicted in Tables 5A and 5B, the temperature detected by the thermistor 27, which is indicative of the temperature elevation state of the image heating apparatus 7, is also correlated with the surface temperature of the pressing roller 22 located opposite to and in contact with the thermistor 27 via the heater 23 and the fixing film 21. That is, the surface temperature of the pressing roller 22 decreases and increases consistently with the temperature detected by the thermistor 27, and this is related to the dew condensation slip, affected by the surface temperature of the pressing roller 22. Therefore, if image formation is performed when the surface temperature is high and at least 65° C., pre-rotation is performed to allow the surface temperature of the pressing roller 22 to be raised enough to prevent steam from being condensed. As a result, possible dew condensation slip is prevented even with the normal sheet interval of 27 mm.

In Embodiment 2, the temperature detected by the thermistor 27 was used as a temperature correlated with the surface temperature of the pressing roller 22. When the detected temperature was at least 100° C., the delay control of the conveyance timing for the subsequent recording material P, which is suppression control of the dew condensation slip, is not performed. Thus, an image forming apparatus can be implemented which allows the delay control to be performed in a more limited manner.

Figure 6:
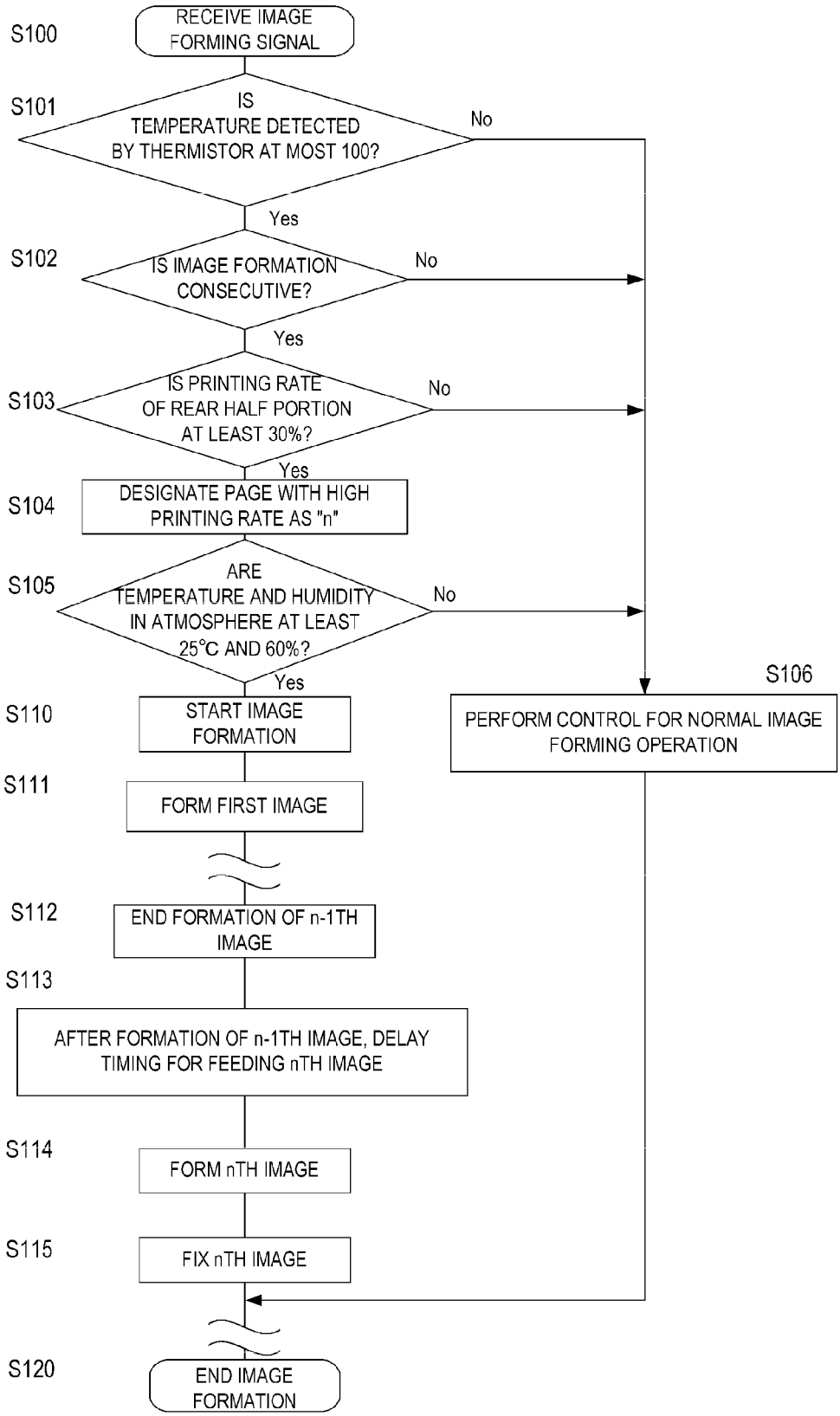
FIG. 6 is a flowchart of condensation slip suppression control according to Embodiment 2.

FIG. 6 depicts a general flowchart of control involving determination for the temperature detected by the thermistor at the beginning of image formation compared to the control in Embodiment 1. As depicted in FIG. 6, upon receiving an image forming signal (S100), the control circuit section 200 determines whether or not the temperature detected by the thermistor 27 exceeds a predetermined temperature at which the dew condensation slip suppression control is not needed (S101) before determining whether or not a number of images are consecutively formed (S102). In the present embodiment, the control circuit section 200 determined whether or not the temperature detected by the thermistor 27 exceeded 100° C. When the detected temperature exceeds 100° C. (S101, Yes), the control circuit section 200 determines a normal image forming operation to be performed and correspondingly controls the components of the image forming apparatus 100 (S106). The control circuit section 200 then ends the image formation (S120). When the detected temperature is equal to or lower than 100° C., the control circuit section 200 performs control similar to the control in Embodiment 1 (S102 to S120).

As described above, the control in Embodiment 2 involves determining whether to perform the dew condensation slip suppression control in accordance with the temperature of the pressing roller 22 correlated with the temperature detected by the thermistor at the beginning of image formation. Thus, an image forming apparatus can be provided which enables a reduction in the number of executions of the dew condensation slip suppression control compared to the number of executions of the dew condensation slip suppression control in Embodiment 1, that is, a reduction in the delay time for the conveyance timing (a reduction in image formation time).

The configuration in the present embodiment makes individual (separate) determinations for the conditions such as "the range of image formation and the printing rate", "the temperature and humidity of the environment in which the apparatus is placed", and "the pressing roller temperature" which are related to the dew condensation slip. However, the control configuration is not limited to this. For example, the control configuration may determine whether to perform control based on a combination of the conditions, that is, whether to perform the dew condensation slip suppression control based on the conditions correlated with one another.

When, during consecutive image formation, the delay control for the conveyance timing according to the present invention is performed to extend the sheet interval, the conveyance timing for the recording material subsequent the recording material on which the delay control has been performed may be controlled in various manners. The present embodiment performs control that delays the conveyance timing for the subsequent recording material similarly to the conveyance timing for the recording material on which the delay control has been performed, that is, control that prevents the once extended sheet interval from being returned during a series of consecutive image forming operations. This control allows possible dew condensation slip to be more reliably avoided. However, if productivity is emphasized, when the printing rate of the preceding recording material decreases enough to prevent possible dew condensation slip, the delay control for the conveyance timing is cancelled to return the sheet interval to the normal value, and the image formation may be continued.

The present embodiment is the image heating apparatus having the film and the heater that heats the film. However, the present embodiment is not limited to this. For example, the image heating apparatus may use a rotating member that performs electromagnetic induction heating or may use an external heating system having a heater that externally heats the rotating member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-124560, filed Jun. 17, 2014, and No. 2015-105776, filed May 25, 2015 which are hereby incorporated by reference herein in their entirety.

What is claimed is:

1. An image forming apparatus that forms a toner image on a recording material comprising:

an image forming portion that forms an unfixed toner image on the recording material, based on image information;

a fixing portion that fixes the unfixed toner image on the recording material while heating and conveying the recording material, on which the unfixed toner image has been formed, at a nip portion, the fixing portion including a first rotating member that contacts the unfixed toner image and a second rotating member that forms the nip portion together with the first rotating member;

an acquisition portion that acquires, from the image information, a rate of a size of an area of the toner image in a predetermined area, which is a part of an image formable area on the recording material, to a size of an area of the predetermined area; and a control portion that controls conveyance of the recording material, wherein, in a consecutive print job, the control portion sets a longer conveyance interval between a preceding recording material and a subsequent recording material when the rate of the subsequent recording material exceeds a threshold than when the rate of the subsequent recording material does not exceed the threshold, and wherein a size of the predetermined area on a trailing end side of the recording material with respect to a center of the recording material in a recording material conveying direction is larger than a size of the predetermined area on a leading end side of the recording material with respect to the center of the recording material, or the predetermined area is only on the trailing end side of the recording material with respect to the center of the recording material.

2. The image forming apparatus according to claim 1, wherein, when a length of the recording material is greater than a peripheral length of the second rotating member in the recording material conveying direction, the predetermined area includes at least an area having a length equivalent to the peripheral length of the second rotating member from the trailing end of the recording material in the recording material conveying direction.

3. The image forming apparatus according to claim 1, further comprising a humidity detecting portion that detects a humidity outside the apparatus, wherein, when the humidity detected by the humidity detecting portion is lower than a predetermined humidity, the conveyance interval, which is set when the rate exceeds the threshold, is equal to the conveyance interval, which is set when the rate does not exceed the threshold.

4. The image forming apparatus according to claim 1, wherein the conveyance interval, which is set when the rate does not exceed the threshold, is shorter than a peripheral length of the second rotating member, and the conveyance interval, which is set when the rate exceeds the threshold, is equal to or longer than the peripheral length of the second rotating member.

5. The image forming apparatus according to claim 1, wherein the first rotating member is rotated by rotation of the second rotating member.

6. The image forming apparatus according to claim 1, wherein the first rotating member is a tubular film.

7. An image forming apparatus that forms a toner image on a recording material comprising:

an image forming portion that forms an unfixed toner image on the recording material, based on image information;

a fixing portion that fixes the unfixed toner image on the recording material while heating and conveying the recording material, on which the unfixed toner image has been formed, at the nip portion, the fixing portion including a first rotating member that contacts the unfixed toner image and a second rotating member that forms the nip portion together with the first rotating member;

an acquisition portion that acquires a rate of a size of an area of the toner image in a predetermined area, which is a part of an image formable area on the recording material, to a size of an area of the predetermined area; and a control portion that controls conveyance of the recording material, wherein, in a consecutive print job, the control portion sets a longer conveyance interval between a preceding recording material and a subsequent recording material when the rate of the subsequent recording material exceeds a threshold than when the rate of the subsequent recording material does not exceed the threshold, and wherein, when a length of the recording material is greater than a peripheral length of the second rotating member in the recording material conveying direction, a size of the predetermined area on a trailing end side of the recording material with respect to a predetermined position is larger than a size of the predetermined area on a leading end side of the recording material with respect to the predetermined position, or the predetermined area is only on the trailing end side of the recording material with respect to the predetermined position, and wherein the predetermined position is at a distance equal to the peripheral length of the second rotating member from a trailing end of the recording material in a recording material conveying direction.

8. The image forming apparatus according to claim 7, further comprising a humidity detecting portion that detects a humidity outside the apparatus, wherein, when the humidity detected by the humidity detecting portion is lower than a predetermined humidity, the conveyance interval, which is set when the rate exceeds the threshold, is equal to the conveyance interval, which is set when the rate does not exceed the threshold.

9. The image forming apparatus according to claim 7, wherein the conveyance interval, which is set when the rate does not exceed the threshold, is shorter than a peripheral length of the second rotating member, and the conveyance interval, which is set when the rate exceeds the threshold, is longer than the peripheral length of the second rotating member.

10. The image forming apparatus according to claim 7, wherein the first rotating member is rotated by rotation of the second rotating member.

11. The image forming apparatus according to claim 7, wherein the first rotating member is a tubular film.

* * * * *